US009509091B2

(12) United States Patent
Hamaoka et al.

(10) Patent No.: US 9,509,091 B2
(45) Date of Patent: Nov. 29, 2016

(54) CONNECTOR ASSEMBLY

(71) Applicant: Japan Aviation Electronics Industry, Limited, Tokyo (JP)

(72) Inventors: Yuji Hamaoka, Tokyo (JP); Masaru Shinmura, Saitama (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 14/800,122

(22) Filed: Jul. 15, 2015

(65) Prior Publication Data

US 2016/0056571 A1 Feb. 25, 2016

(30) Foreign Application Priority Data

Aug. 22, 2014 (JP) ..... 2014-169421

(51) Int. Cl.

| | |
|---|---|
| ***H01R 25/00*** | (2006.01) |
| ***H01R 13/629*** | (2006.01) |
| ***H01R 13/641*** | (2006.01) |
| ***H01R 13/703*** | (2006.01) |

(52) U.S. Cl.

CPC .. *H01R 13/62944* (2013.01); *H01R 13/62955* (2013.01); *H01R 13/641* (2013.01); *H01R 13/7033* (2013.01)

(58) Field of Classification Search

CPC ..... H01R 13/6272; H01R 13/62944; H01R 13/62955; H01R 13/641; H01R 13/7033; H01R 13/7032

USPC ..... 439/188, 488, 489, 638, 157

See application file for complete search history.

(56) References Cited

U.S. PATENT DOCUMENTS

| | | | | |
|---|---|---|---|---|
| 5,722,925 | A * | 3/1998 | Kameyama | H01R 13/113 600/453 |
| 5,743,760 | A * | 4/1998 | Inaba | H01R 13/7031 439/489 |
| 5,863,216 | A * | 1/1999 | Tsuji | H01R 13/7031 439/489 |
| 6,095,873 | A * | 8/2000 | Muramatsu | H01R 11/22 439/852 |
| 6,116,970 | A * | 9/2000 | Yamamoto | H01R 13/113 439/852 |
| 6,428,365 | B1 * | 8/2002 | Yamamoto | H01R 13/113 439/843 |
| 7,445,491 | B2 * | 11/2008 | Fujii | H01R 13/62938 439/157 |
| 8,851,921 | B2 * | 10/2014 | Segawa | H01R 13/6271 439/489 |

FOREIGN PATENT DOCUMENTS

| | | |
|---|---|---|
| JP | 2014-011119 | 1/2014 |
| JP | 2014-056718 | 3/2014 |

* cited by examiner

*Primary Examiner* — Amy Cohen Johnson
*Assistant Examiner* — Milagros Jeancharles
(74) *Attorney, Agent, or Firm* — Muncy, Geissler, Olds & Lowe, P.C.

(57) ABSTRACT

A connector assembly includes a first connector having a first terminal and a second terminal which are used for fitting detection, a second connector fitted with the first connector, a manipulation lever for use in fitting the second connector with the first connector along a fitting direction, a fitting lock mechanism adapted to lock a fitting state of the first connector and the second connector and a fitting detection mechanism disposed at the second connector and adapted to short-circuit between the first terminal and the second terminal when the first connector and the second connector are fitted with each other, the fitting detection mechanism having a first contact point, a second contact point and a third contact point that are arranged in series between the first terminal and the second terminal when the first connector and the second connector are fitted with each other.

9 Claims, 9 Drawing Sheets

CONNECTOR ASSEMBLY

BACKGROUND OF THE INVENTION

The present invention relates to a connector assembly, particularly to a connector assembly having a fitting detection mechanism for electrically detecting the fitting state of a pair of connectors.

Such a fitting detection mechanism has, for example, a fitting detection circuit composed of two detection terminals and a short-circuit member. When a pair of connectors are fitted with each other, the two detection terminals are short-circuited with the short-circuit member so that the fitting detection circuit is closed, thereby detecting the fitting state.

A connector assembly equipped with this type of fitting detection mechanism is disclosed by JP 2014-056718 A in which two detection terminals 1 are disposed at one connector in parallel to each other along an fitting direction D and a short-circuit member 2 having two contact portions 2A is disposed at the other connector, as shown in FIG. 24.

When the connectors are fitted with each other along the fitting direction D, ends of the two detection terminals 1 are brought into contact with the two contact portions 2A of the short-circuit member 2 and then, the detection terminals 1 are further moved relatively in the fitting direction D as rubbing and wiping the corresponding contact portions 2A. Once the fitting of the connectors is established, the fitting state of the connectors is locked by a lock mechanism which is not shown.

JP 2014-011119 A discloses a connector assembly in which a detection terminal 4 extending along a fitting direction D is disposed at a first connector 3 and a main body terminal 7 is disposed at a connector housing 6 of a second connector 5, as shown in FIG. 25. In FIG. 25 showing a cross-section of the connector assembly, one detection terminal 4 and one main body terminal 7 are only shown in the figure but two detection terminals 4 are disposed at the first connector 3 in parallel to each other and two main body terminals 7 corresponding thereto are disposed at the second connector 5.

The rear ends of the two main body terminals 7 extending in the opposite direction from the first connector 3 are movable free ends at each of which a contact portion 7B is formed through a curved spring portion 7A. In addition, a short-circuit member 8 for short-circuiting the contact portions 7B of the two main body terminals 7 is fixed at the connector housing 6 of the second connector 5 and when the second connector 5 is not fitted with the first connector 3, the contact portions 7B of the two main body terminals 7 are in contact with the short-circuit member 8 and thus short-circuited.

When a manipulation lever 9 attached to the second connector 5 is rotated to start the fitting between the first connector 3 and the second connector 5, the detection terminals 4 are, as wiping, brought into contact with the corresponding main body terminals 7 and at the same time, a movable arm 10 formed in the connector housing 6 of the second connector 5 is pushed down by the manipulation lever 9 to displace the spring portions 7A of the main body terminals 7 downward, whereby the contact portions 7B of the two main body terminals 7 are separated from the short-circuit member 8 as shown in FIG. 25.

Once the fitting between the first connector 3 and the second connector 5 is established, a projection 9A of the manipulation lever 9 is caught on a projection 6A of the connector housing 6 so that the manipulation lever 9 is restrained from rotating, whereby the fitting state of the first connector 3 and the second connector 5 is locked. Simultaneously, the spring portions 7A of the main body terminals 7 having been pushed down by the manipulation lever 9 are restored to the position before fitting so that the contact portions 7B of the two main body terminals 7 are brought into contact with the short-circuit member 8 and thus short-circuited, thereby closing a fitting detection circuit.

However, the connector assembly disclosed by JP 2014-056718 A has a problem in that the two detection terminals 1 are brought into contact with the two contact portions 2A of the short-circuit member 2 to close the fitting detection circuit before the fitting of the connectors is established and therefore, the connector assembly is unable to accurately detect the fact that the fitting state of the connectors has been locked.

In the connector assembly disclosed by JP 2014-011119 A, since the spring portions 7A of the main body terminals 7 having been pushed down by the manipulation lever 9 are restored to the position before fitting whereby surfaces of the contact portions 7B of the main body terminals 7 and a surface of the short-circuit member 8 facing thereto are brought into contact with each other, the distance by which the contact portions 7B of the main body terminals 7 and the short-circuit member 8 rub each other is short and therefore, the wiping has only a small effect.

Furthermore, the fitting detection circuit has the configuration in which four contact points, that is, two contact points established between the two detection terminals 4 and the two main body terminals 7 and two contact points established between the contact portions 7B of the two main body terminals 7 and the short-circuit member 8, are all arranged in series.

Therefore, the fitting detection circuit has poor reliability as a detection circuit.

SUMMARY OF THE INVENTION

The present invention has been made to overcome the above problems associated with the prior art and aims at providing a connector assembly that can reliably detect the fact that the fitting state of connectors has been locked.

A connector assembly according to the present invention comprising a first connector having a first terminal and a second terminal which are used for fitting detection; a second connector fitted with the first connector; a manipulation lever for use in fitting the second connector with the first connector along a fitting direction; a fitting lock mechanism adapted to lock a fitting state of the first connector and the second connector; and a fitting detection mechanism disposed at the second connector and adapted to short-circuit between the first terminal and the second terminal when the first connector and the second connector are fitted with each other, wherein the fitting detection mechanism has a first contact point, a second contact point and a third contact point that are arranged in series between the first terminal and the second terminal when the first connector and the second connector are fitted with each other, with the first contact point being established between the first terminal and a first socket which is disposed at the second connector and in which the first terminal is able to be inserted along the fitting direction with fitting between the first connector and the second connector; the third contact point being established between the second terminal and a second socket which is disposed at the second connector and in which the second terminal is able to be inserted along the fitting direction with fitting between the first connector and the second connector; and the second contact point being established between a first spring piece formed at the first socket and a second spring piece formed at the second socket, and wherein the second spring piece is in an initial position where the second spring piece is in contact with the first spring piece before the first connector and the second connector are fitted with each other; when the manipulation lever is manipulated to start fitting between the first connector and the second connector, the second spring piece is pushed by the manipulation lever and separated from the first spring piece so that the second contact point is opened, and the first terminal and the second terminal are respectively inserted in the first socket and the second socket and, as wiping in the fitting direction, brought into contact with the first socket and the second socket so that the first contact point and the third contact point are closed; and when the manipulation lever is manipulated to fit the first connector and the second connector with each other, while the fitting lock mechanism locks the fitting state of the first connector and the second connector, the second spring piece is released by the manipulation lever from a position where the second spring piece is pushed so that the second spring piece is restored to the initial position and, as wiping in a direction different from the fitting direction, brought into contact with the first spring piece so that the second contact is closed whereby the first terminal and the second terminal are short-circuited.

DETAILED DESCRIPTION OF THE INVENTION

An embodiment of the present invention will be described below based on the appended drawings.

Figure 1:
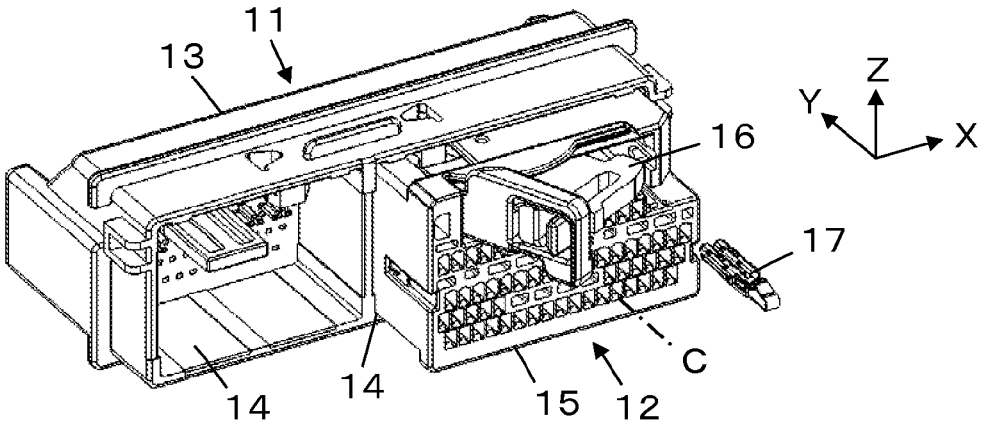
FIG. 1 is a perspective view showing a connector assembly according to an embodiment of the present invention.

FIG. 1 shows the configuration of a connector assembly according to the embodiment of the present invention. The connector assembly includes a first connector 11 and a second connector 12 that is fitted with the first connector 11 along a fitting axis C. The first connector 11 includes a first housing 13 formed of an insulator holding a number of male terminals (not shown), and two connector accommodating portions 14 are formed at the first housing 13 to be adjacent to each other. FIG. 1 shows the state where the second connector 12 is inserted into one of the two connector accommodating portions 14.

The second connector 12 includes a second housing 15 formed of an insulator holding a number of female terminals (not shown), as well as a manipulation lever 16 rotatably attached to an upper portion of the second housing 15. The second connector 12 further includes a fitting detection mechanism 17 inserted and fixed in the second housing 15.

For convenience, a direction from the second connector 12 to the first connector 11 along the fitting axis C is called "+Y direction"; a direction along which the two connector accommodating portions 14 are arranged, from one connector accommodating portion 14 in which the second connector 12 is not inserted to the other connector accommodating portion 14 in which the second connector 12 is inserted is called "+X direction"; and a direction perpendicular to the XY plane is called "Z direction."

Figure 2:
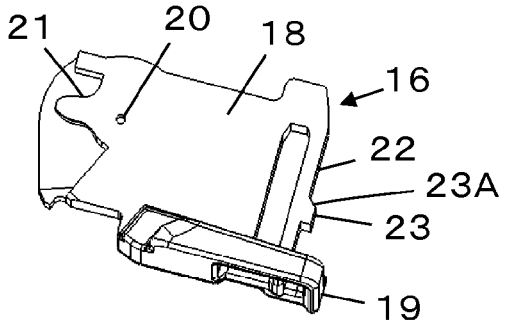
FIG. 2 is a perspective view showing a manipulation lever used in the connector assembly in the embodiment.

As shown in FIG. 2, the manipulation lever 16 includes a lever body 18 having a flat plate shape and a handle 19 connected to the lever body 18. The lever body 18 has formed therein a through-hole 20 that is the center of rotation when the manipulation lever 16 is rotated, and a projection 21 that is formed near the through-hole 20 and projects in a direction away from the through-hole 20 in the same plane as the lever body 18.

The lever body 18 further includes a lock arm 22 having a cantilever shape, and a locking protrusion 23 is formed at the lock arm 22. A taper face 23A is formed at an edge of the locking protrusion 23 facing the root portion of the lock arm 22.

Figure 3:
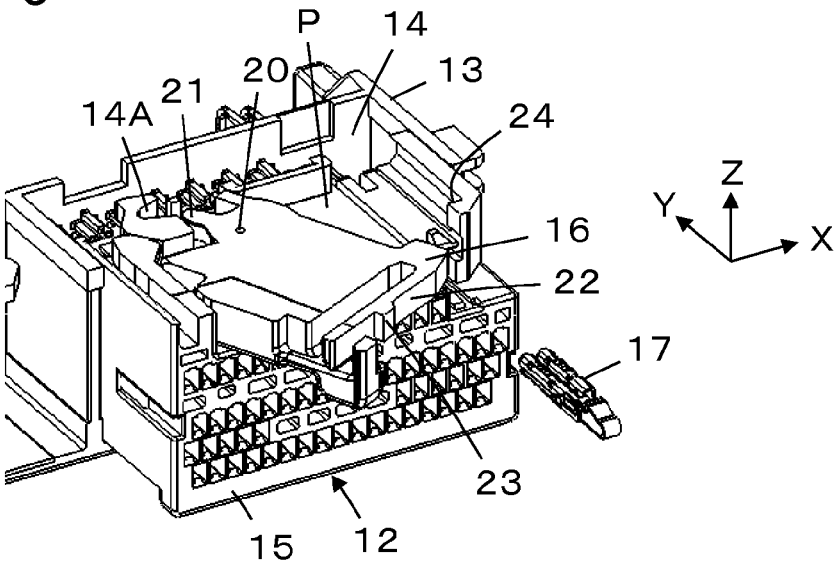
FIG. 3 is a partially broken perspective view showing a main part of the connector assembly.

As shown in FIG. 3, the manipulation lever 16 is attached to the second housing 15 so as to be, about a rotation shaft (not shown) inserted through the through-hole 20 of the lever body 18, rotatable back and forth between a connector separating position and a connector fitting position on a lever moving plane P formed at the second housing 15 along the XY plane. The second housing 15 has a lock arm receiving portion 24 on which the locking protrusion 23 of the lock arm 22 of the manipulation lever 16 rotated to the connector fitting position is caught. The lock arm receiving portion 24 of the second housing 15 and the lock arm 22 of the manipulation lever 16 constitute a fitting lock mechanism used for locking the fitting state of the first connector 11 and the second connector 12. Note that FIG. 3 shows the manipulation lever 16 being in the connector separating position.

A recess 14A is formed at the first housing 13 at a position inside the connector accommodating portion 14.

The recess 14A is positioned to be at the same height in the Z direction as the height of the lever body 18 of the manipulation lever 16 of the second connector 12 when the second connector 12 is inserted in the connector accommodating portion 14, and constitutes a so-called rack-and-pinion mechanism in combination with the projection 21 of the manipulation lever 16. More specifically, when the manipulation lever 16 is rotated counterclockwise in FIG. 3 with the second connector 12 being inserted in the connector accommodating portion 14 of the first housing 13, the projection 21 of the manipulation lever 16 is brought into contact with the recess 14A of the first housing 13 and enters the recess 14A, whereby the second connector 12 is linearly moved in the +Y direction that is the fitting direction. When the manipulation lever 16 is, in reverse, rotated clockwise under the condition where the first connector 11 and the second connector 12 are fitted, the projection 21 of the manipulation lever 16 and the recess 14A of the first housing 13 act on each other and the second connector 12 is linearly moved in the −Y direction, accordingly.

Figure 4:
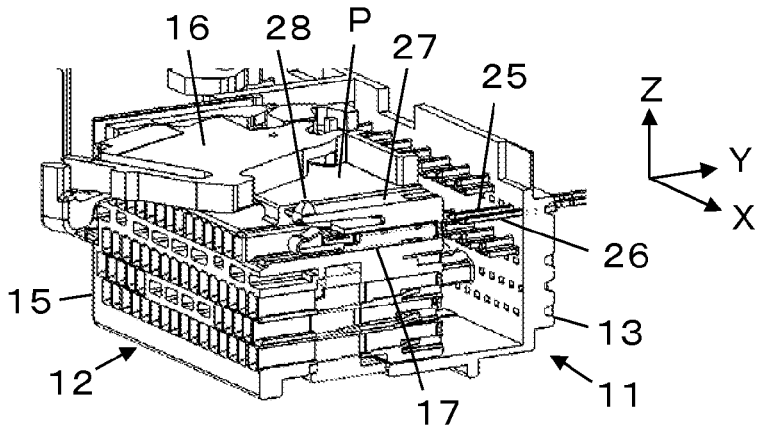
FIG. 4 is a partially broken perspective view showing the inside of the connector assembly.

As shown in FIG. 4, the first housing 13 of the first connector 11 holds first and second terminals 25 and 26 having a pin shape and used for fitting detection, which extend in parallel to each other from the back of the first housing 13 in the −Y direction along the fitting direction in the connector accommodating portion 14. The fitting detection mechanism 17 inserted and fixed in the second housing 15 of the second connector 12 is located on the extension lines of the first and second terminals 25 and 26 extending in the −Y direction.

A movable arm 27 having a cantilever shape extending in the −Y direction is formed at the second housing 15 of the second connector 12 at a position immediately above the fitting detection mechanism 17. The movable arm 27 is formed so that its tip end is elastically shiftable in the Z direction, and a jut 28 projecting in the +Z direction is formed at the tip end of the movable arm 27.

Figure 5:
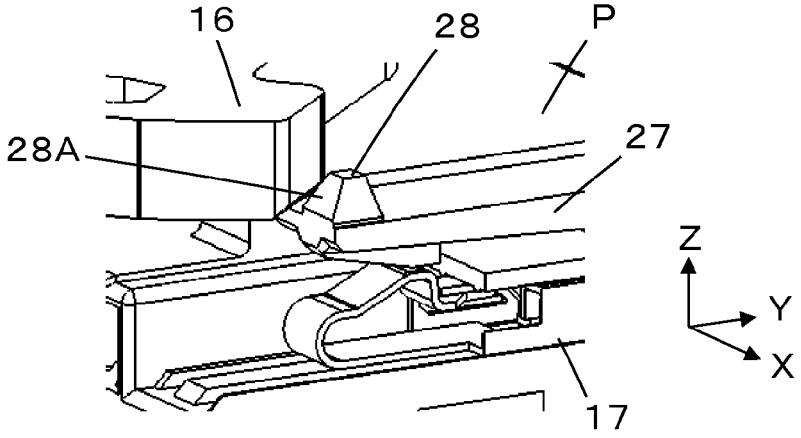
FIG. 5 is a partially broken, enlarged perspective view showing the inside of the connector assembly.

While the top surface of the movable arm 27 is positioned at a height substantially equal to or slightly lower than the height of the lever moving plane P in the Z direction, the jut 28 projects over the lever moving plane P in the +Z direction and is positioned to interfere with the rotational trajectory of the manipulation lever 16 as shown in FIG. 5. A taper face 28A facing the −Y direction and the +Z direction is formed at the jut 28 and when the manipulation lever 16 is rotated along the lever moving plane P, the manipulation lever 16 is brought into contact with the taper face 28A of the jut 28 and pushes down the jut 28 in the −Z direction.

Figure 6:
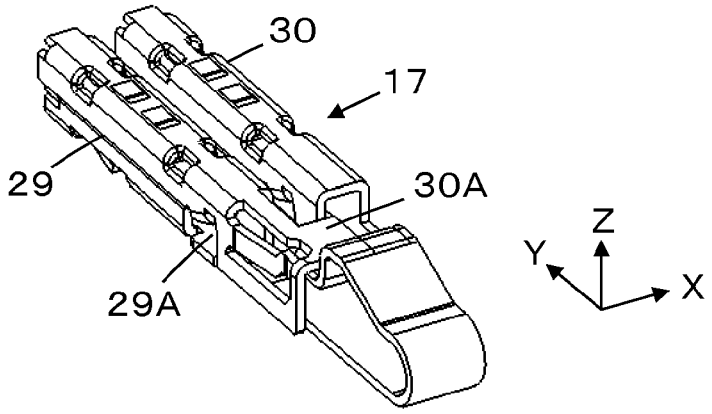
FIG. 6 is a perspective view showing a fitting detection mechanism used in the connector assembly.

The fitting detection mechanism 17 includes first and second sockets 29 and 30 made of metal, which extend in the Y direction and are arranged adjacent to each other in the X direction, as shown in FIG. 6.

The first socket 29 has a terminal accommodating portion 29A therein. When the first connector 11 is fitted with the second connector 12, the first terminal 25 held at the first housing 13 of the first connector 11 is inserted in the terminal accommodating portion 29A so that the first socket 29 is electrically connected to the first terminal 25. A first contact point of the fitting detection mechanism 17 is established between the first socket 29 and the first terminal 25.

Similarly, the second socket 30 has a terminal accommodating portion 30A therein. When the first connector 11 is fitted with the second connector 12, the second terminal 26 held at the first housing 13 of the first connector 11 is inserted in the terminal accommodating portion 30A so that the second socket 30 is electrically connected to the second terminal 26. A third contact point of the fitting detection mechanism 17 is established between the second socket 30 and the second terminal 26.

Figure 7:
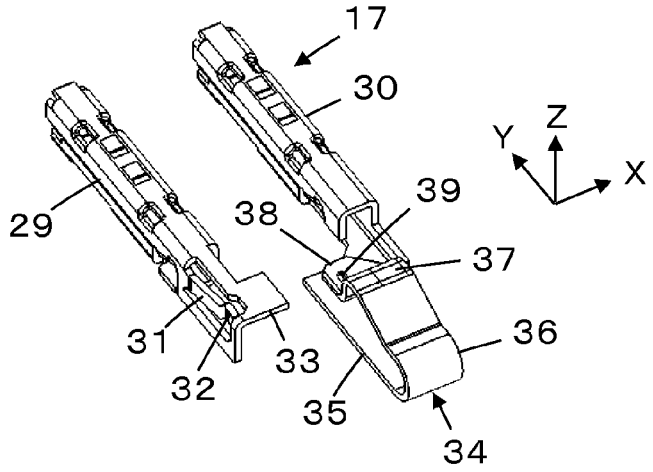
FIG. 7 is a perspective view showing first and second sockets of the fitting detection mechanism that are separated from each other.

FIG. 7 shows the first and second sockets 29 and 30 separated from each other in the X direction. A first spring piece 31 composed of a metal plate and extending in the −Y direction in the YZ plane is integrally formed at the first socket 29 and has, formed at its −Y direction-side end, a first end flat plate portion 32 that has a flat plate shape extending along the YZ plane and that is elastically displaced in the X direction with the elastic deformation of the first spring piece 31. A plate portion 33 extending in the −Y direction in the XY plane is also integrally formed at the first socket 29. The plate portion 33 is composed of a metal plate overhanging in the +X direction beyond the central axis of the first socket 29, that is, toward the second socket 30.

On the other hand, a second spring piece 34 is integrally formed at a −Y direction-side end of the second socket 30. The second spring piece 34 is composed of a metal plate overhanging in the −X direction beyond the central axis of the second socket 30, that is, toward the first socket 29 and includes a base flat plate portion 35 extending from the −Y direction-side end of the second socket 30 in the −Y direction in the XY plane, a folded portion 36 extending from the −Y direction-side end of the base flat plane portion 35 and folded toward the +Z direction and then the +Y direction, an apex 37 formed at the folded portion 36 and facing the +Z direction, and a second end flat plate portion 38 extending down from the apex 37 toward the −Z direction and then extending in the +Y direction in the XY plane. The second end flat plate portion 38 is elastically displaced in the Z direction with the elastic deformation of the second spring piece 34.

The second end flat plate portion 38 has formed on its surface a protrusion 39 protruding in the +Z direction.

Figure 8:
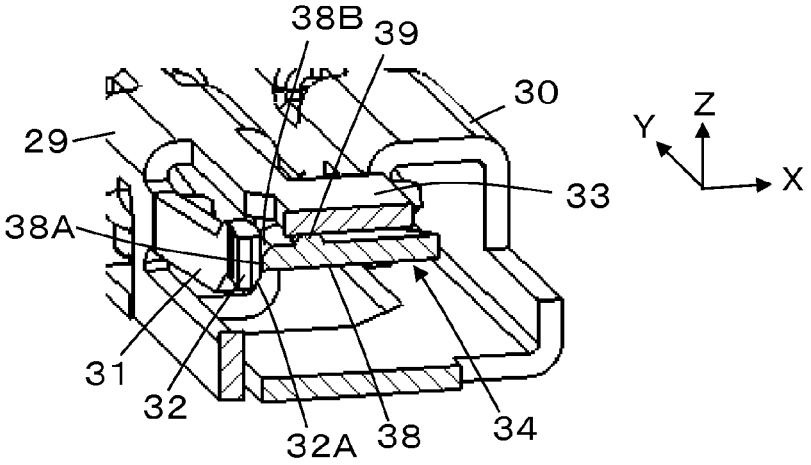
FIG. 8 is a partially broken perspective view showing a second contact point established by a first spring piece of the first socket and a second spring piece of the second socket.

The first socket 29 and the second socket 30 are arranged adjacent to each other in the X direction in the second housing 15 and positioned with the plate portion 33 of the first socket 29 and the second end flat plate portion 38 of the second spring piece 34 of the second socket 30 overlapping each other in parallel as shown in FIG. 8. In other words, the second end flat plate portion 38 of the second spring piece 34 of the second socket 30 is positioned at the −Z direction side of the plate portion 33 of the first socket 29. When the manipulation lever 16 is in the connector separating position, the second spring piece 34 is in the initial position and due to the elasticity of the second spring piece 34, the protrusion 39 of the second spring piece 34 is in contact with and is pressed against a surface of the plate portion 33 of the first socket 29.

At this time, due to the elasticity of the first spring piece 31, a surface of the first end flat plate portion 32 of the first spring piece 31 is in contact with and is pressed against a side edge 38A of the second end flat plate portion 38 of the second spring piece 34.

A taper face 32A facing the +X direction and the −Z direction is formed at a −Z direction-side end of the surface of the first end flat plate portion 32 which is to be brought in contact with the side edge 38A of the second end flat plate portion 38, while a taper face 38B facing the −X direction and the +Z direction is formed at the side edge 38A of the second end flat plate portion 38.

Figure 9:
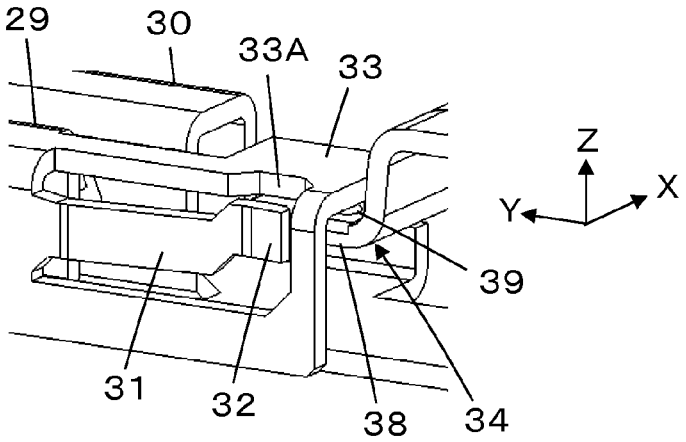
FIG. 9 is a partial perspective view showing the first spring piece of the first socket.

As shown in FIG. 9, a notch 33A is formed at a side edge of the plate portion 33 of the first socket 29 at the −X direction side to thereby avoid hampering the elastic displacement of the first end flat plate portion 32 of the first spring piece 31.

A second contact point of the fitting detection mechanism 17 is established between the surface of the first end flat plate portion 32 of the first spring piece 31 and the side edge 38A of the second end flat plate portion 38 of the second spring piece 34, and a fourth contact point of the fitting detection mechanism 17 is established between the protrusion 39 of the second spring piece 34 and the surface of the plate portion 33 of the first socket 29.

Thus, the first contact point established between the first socket 29 and the first terminal 25, the second contact point established between the first spring piece 31 of the first socket 29 and the second spring piece 34 of the second socket 30 and the third contact point established between the second socket 30 and the second terminal 26 are arranged in series between the first and second terminals 25 and 26 held by the first housing 13 of the first connector 11.

In addition, the fourth contact point established between the plate portion 33 of the first socket 29 and the second spring piece 34 of the second socket 30 is arranged in parallel to the second contact point established between the first spring piece 31 of the first socket 29 and the second spring piece 34 of the second socket 30.

The fitting detection circuit constituted by the first, second and third contact points arranged in series is formed between the first and second terminals 25 and 26 and in addition, the fourth contact point is arranged in parallel to the second contact point, thereby improving the reliability of fitting detection.

Next, the operation of fitting the first connector 11 and the second connector 12 will be described.

Figure 10:
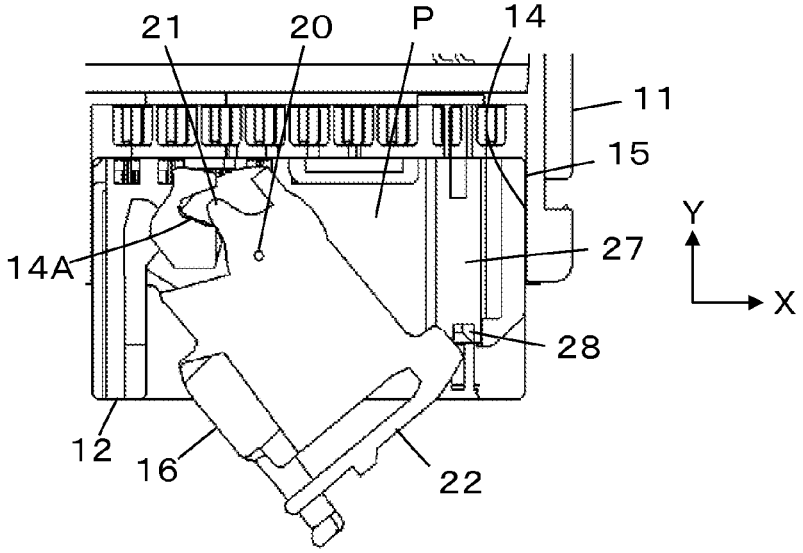
FIG. 10 is a partially broken plan view showing a second connector before fitting.
Figure 11:
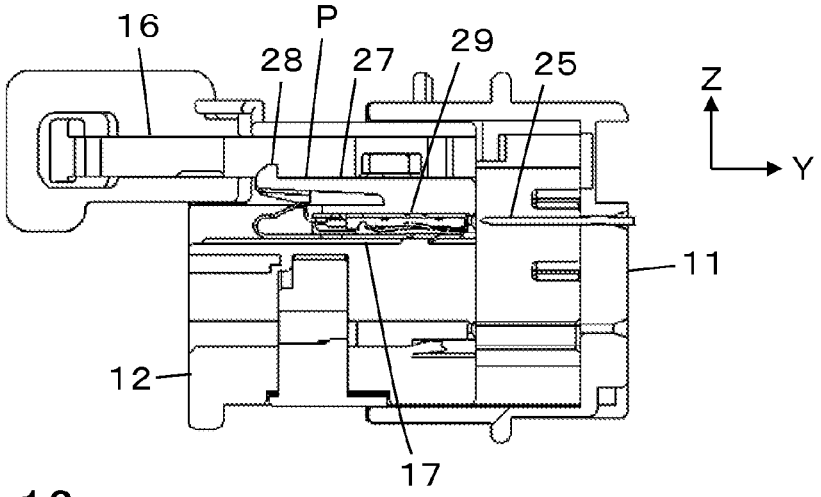
FIG. 11 is a partially broken side view showing the connector assembly before fitting.

First, the second connector 12 is inserted into the connector accommodating portion 14 of the first connector 11 along the fitting axis C. When the manipulation lever 16 is in the connector separating position on the lever moving plane P, as shown in FIG. 10, the jut 28 formed at the tip end of the movable arm 27 of the second connector 12 is not pushed by the manipulation lever 16 and as shown in FIG. 11, the top surface of the movable arm 27 is positioned substantially parallel to the lever moving plane P and the jut 28 projects over the lever moving plane P in the +Z direction.

Figure 12:
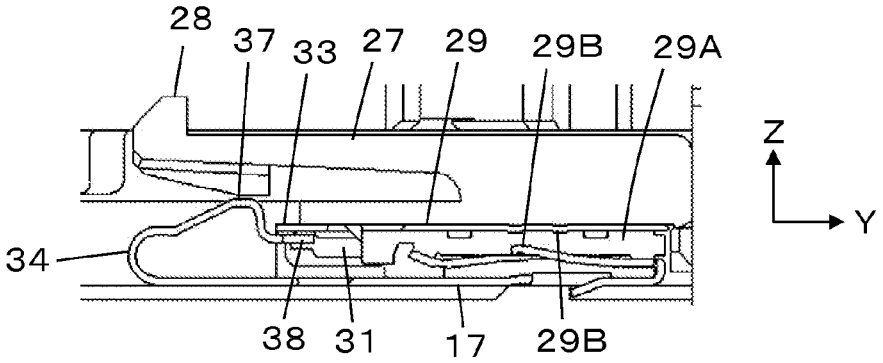
FIG. 12 is a cross-sectional view showing the fitting detection mechanism before fitting.

Accordingly, as shown in FIG. 12, the apex 37 of the second spring piece 34 of the second socket 30 is not pushed by the movable arm 27, the second spring piece 34 is in the initial position, and the second end flat plate portion 38 of the second spring piece 34 is connected to the plate portion 33 of the first socket 29 and also to the first spring piece 31 of the first socket 29. Thus, the second and fourth contact points of the fitting detection mechanism 17 are closed.

At this time, however, the first terminal 25 and the second terminal 26 have not yet been inserted in the terminal accommodating portion 29A of the first socket 29 and the terminal accommodating portion 30A of the second socket 30, respectively, and therefore, the first contact point established between the first socket 29 and the first terminal 25 and the third contact point established between the second socket 30 and the second terminal 26 are both open. Thus, the fitting detection circuit between the first and second terminals 25 and 26 is in the open state.

In FIG. 12, a plurality of contact portions 29B formed in the terminal accommodating portion 29A of the first socket 29 are shown. When the first terminal 25 is inserted in the terminal accommodating portion 29A, these contact portions 29B are brought into contact with the first terminal 25 so that the first socket 29 and the first terminal 25 are interconnected.

Although not shown, a plurality of similar contact portions are formed also in the terminal accommodating portion 30A of the second socket 30 and when the second terminal 26 is inserted in the terminal accommodating portion 30A, these contact portions are brought into contact with the second terminal 26 so that the second socket 30 and the second terminal 26 are interconnected.

Figure 13:
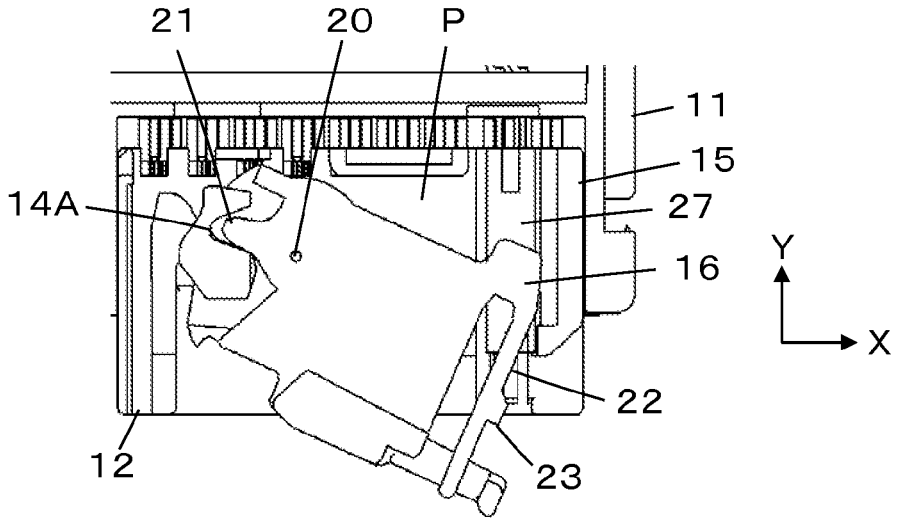
FIG. 13 is a partially broken plan view showing the second connector during a fitting process.

Subsequently, as shown in FIG. 13, when the manipulation lever 16 is pushed toward the first connector 11 and thereby rotated counterclockwise on the lever moving plane P, the projection 21 of the manipulation lever 16 is brought into contact with the recess 14A of the first housing 13 and enters the recess 14A, and the second connector 12 is linearly moved in the +Y direction to start the fitting between the first connector 11 and the second connector 12.

Figure 14:
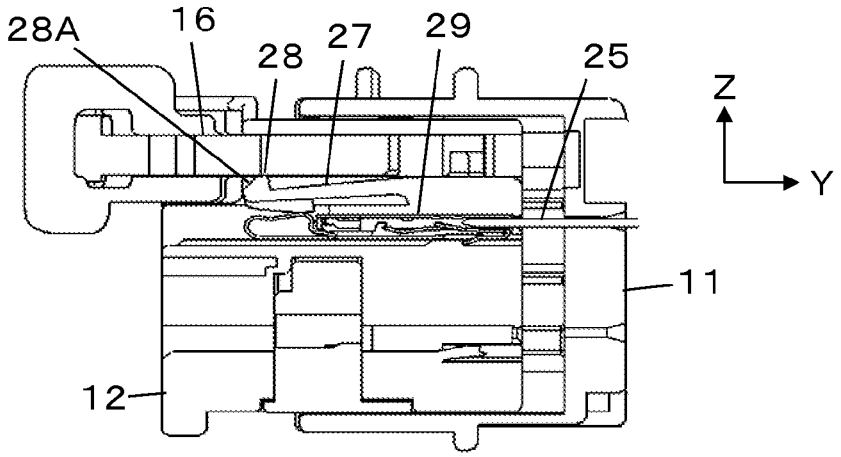
FIG. 14 is a partially broken side view showing the connector assembly during the fitting process.

At this time, the manipulation lever 16 is brought into contact with the taper face 28A of the jut 28 formed at the movable arm 27 of the second housing 15 so that the movable arm 27 is elastically deformed and the jut 28 is displaced in the −Z direction, as shown in FIG. 14.

Figure 15:
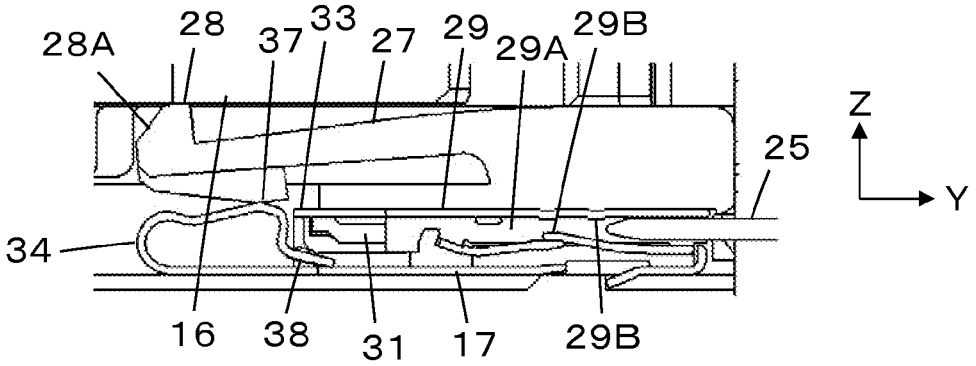
FIG. 15 is a cross-sectional view showing the fitting detection mechanism during the fitting process.

Consequently, the apex 37 of the second spring piece 34 is pushed in the −Z direction by the movable arm 27 whereby the second spring piece 34 is elastically deformed and the second end flat plate portion 38 is displaced in the −Z direction, as shown in FIG. 15. As a result, the second end flat plate portion 38 of the second spring piece 34 is separated from the plate portion 33 and the first spring piece 31 of the first socket 29 and thus, the second and fourth contact points of the fitting detection mechanism 17 are opened.

Meanwhile, although the tip ends of the first and second terminals 25 and 26 are being inserted into the terminal accommodating portion 29A of the first socket 29 and the terminal accommodating portion 30A of the second socket 30, respectively, they have not yet reached the contact portions 29B in the terminal accommodating portion 29A and the contact portions in the terminal accommodating portion 30A.

When the manipulation lever 16 is further rotated, while the fitting between the first and second connectors 11 and 12 proceeds according to the rotation angle of the manipulation lever 16, the jut 28 formed at the tip end of the movable arm 27 is positioned immediately below the lock arm 22 of the manipulation lever 16, that is, at the −Z direction side. Due to the jut 28 displaced in the −Z direction, the second and fourth contact points of the fitting detection mechanism 17 are kept in the open state.

Figure 16:
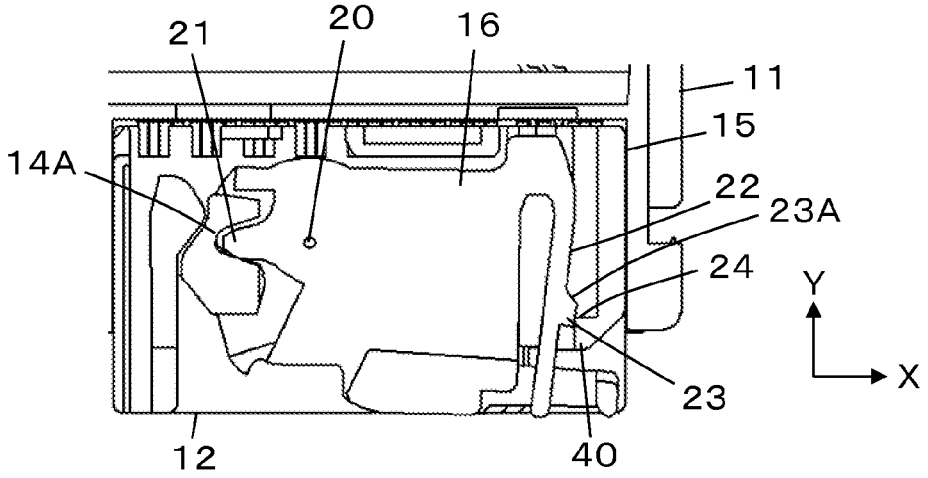
FIG. 16 is a partially broken plan view showing the second connector immediately before the fitting is established.

When with the rotation of the manipulation lever 16, the taper face 23A of the locking protrusion 23 formed at the lock arm 22 of the manipulation lever 16 is brought into contact with a wall portion 40 at which the lock arm receiving portion 24 of the second housing 15 is formed, the lock arm 22 is elastically deformed so that the locking protrusion 23 is displaced in the −X direction, as shown in FIG. 16.

Figure 17:
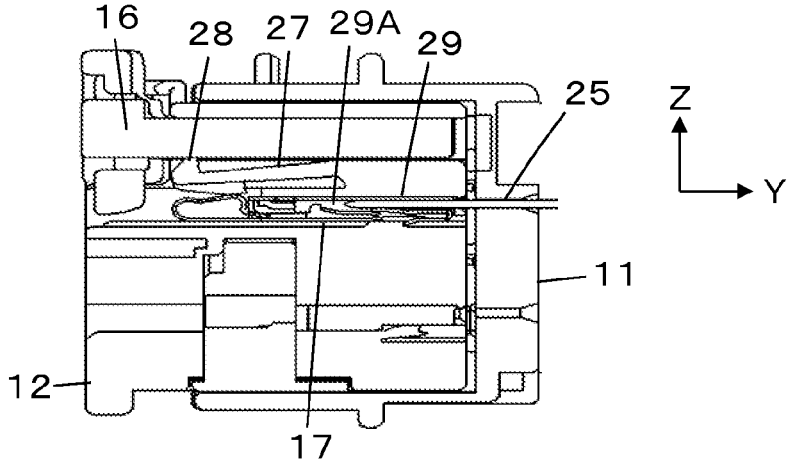
FIG. 17 is a partially broken side view showing the connector assembly immediately before the fitting is established.
Figure 18:
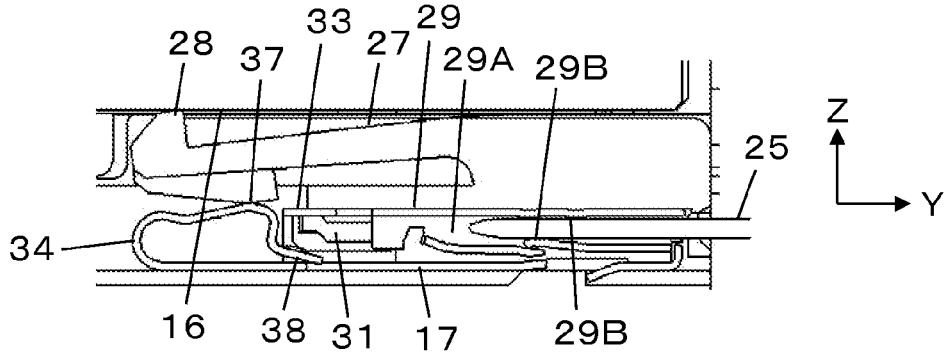
FIG. 18 is a cross-sectional view showing the fitting detection mechanism immediately before the fitting is established.

At this time, the jut 28 formed at the tip end of the movable arm 27 is still positioned immediately below the lock arm 22 of the manipulation lever 16, that is, at the −Z direction side as shown in FIG. 17, which allows the second end flat plate portion 38 of the second spring piece 34 to be displaced in the −Z direction as shown in FIG. 18. Thus, the second and fourth contact points of the fitting detection mechanism 17 are still kept open.

When the manipulation lever 16 is rotated to the position where the locking protrusion 23 is brought into contact with the wall portion 40 of the second housing 15 and displaced in the −X direction, as shown in FIG. 18, the first terminal 25 is, as wiping in the Y direction, brought into contact with the contact portions 29B in the terminal accommodating portion 29A of the first socket 29 while the second terminal 26 is, as wiping in the Y direction, brought into contact with the contact portions in the terminal accommodating portion 30A of the second socket 30 in the same manner, so that the first and third contact points of the fitting detection mechanism 17 are closed. Since the first and third contact points are closed as the first and second terminals 25 and 26 carry out the wiping action as described above, the possibility of poor electrical connection induced by foreign matter can be eliminated.

Figure 19:
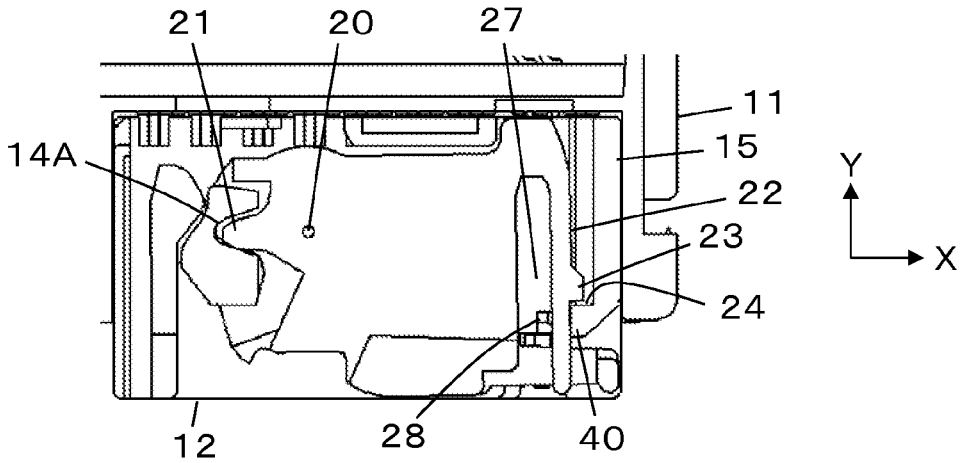
FIG. 19 is a partially broken plan view showing the second connector when the fitting state is locked.

When the manipulation lever 16 is further rotated to the connector fitting position as shown in FIG. 19, the locking protrusion 23 formed at the lock arm 22 of the manipulation lever 16 is caught on the lock arm receiving portion 24 of the second housing 15, whereupon the fitting between the first and second connectors 11 and 12 is established, and a number of male terminals of the first connector 11 and a number of female terminals of the second connector 12 are interconnected. At the same time, the fitting state of the first and second connectors 11 and 12 is locked by the fitting lock mechanism constituted by the lock arm 22 and the lock arm receiving portion 24.

Figure 20:
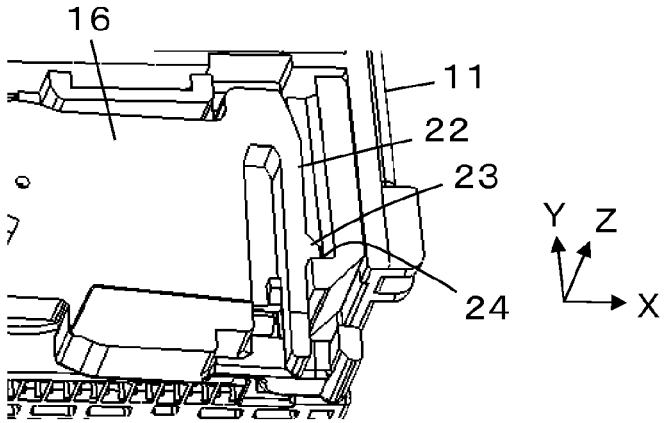
FIG. 20 is a perspective view showing the positional relation between a lock arm and a lock arm receiving portion when the fitting state is locked.
Figure 21:
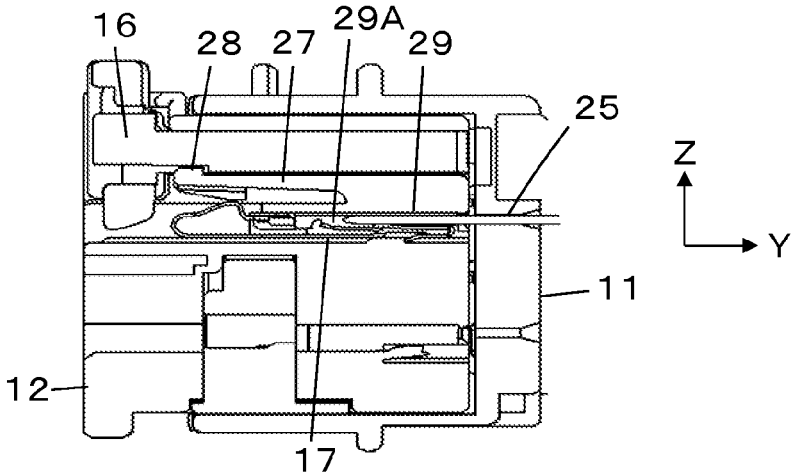
FIG. 21 is a partially broken side view showing the connector assembly when the fitting state is locked.

When the locking protrusion 23 is caught on the lock arm receiving portion 24, the lock arm 22 is released from the elastically-deformed position and displaced in the +X direction. Consequently, the lock arm 22 assumes a position not corresponding to the jut 28 formed at the tip end of the movable arm 27 of the lock arm 22 as shown in FIG. 20, and the movable arm 27 is released from the elastically-deformed position as shown in FIG. 21.

Figure 22:
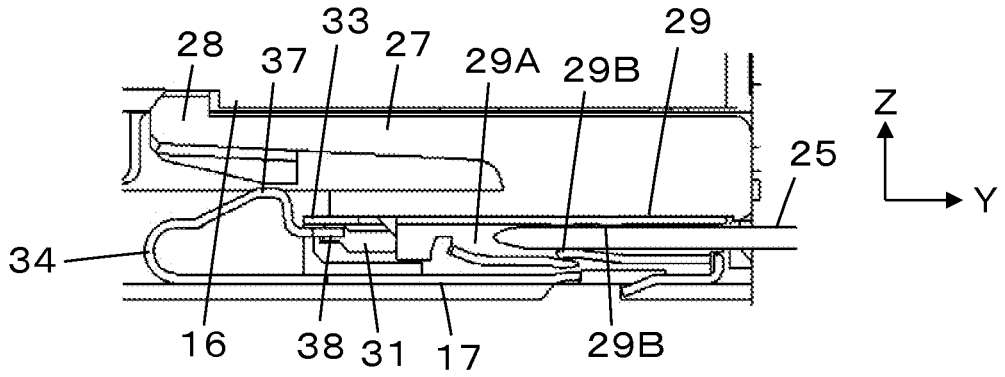
FIG. 22 is a cross-sectional view showing the fitting detection mechanism when the fitting state is locked.

Accordingly, as shown in FIG. 22, the second spring piece 34 is restored to the initial position, and the second end flat plate portion 38 of the second spring piece 34 is connected to the plate portion 33 of the first socket 29 and also to the first spring piece 31 of the first socket 29. Thus, the second and fourth contact points of the fitting detection mechanism 17 are closed.

Figure 23A:
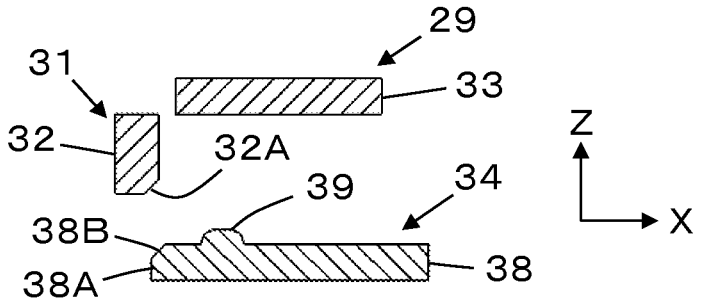
FIGS. 23A to 23C are cross-sectional views showing in steps how the second contact point and a fourth contact point are closed.
Figure 23B:
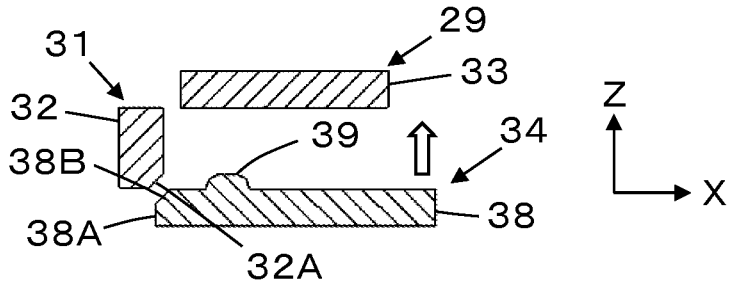
Figure 23C:
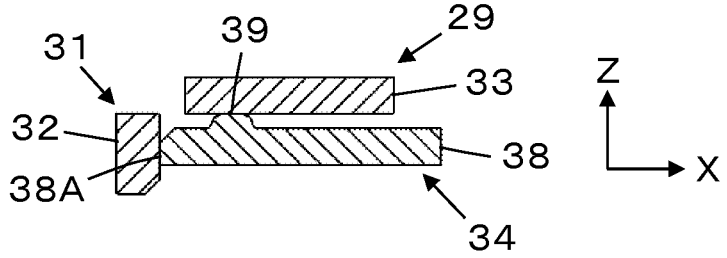
Figure 24:
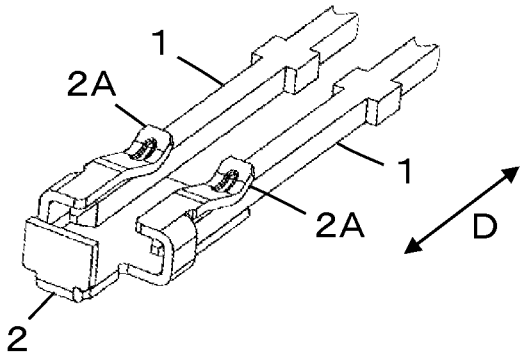
FIG. 24 PRIOR ART
FIG. 24 is a perspective view showing a fitting detection mechanism used in a conventional connector assembly.
Figure 25:
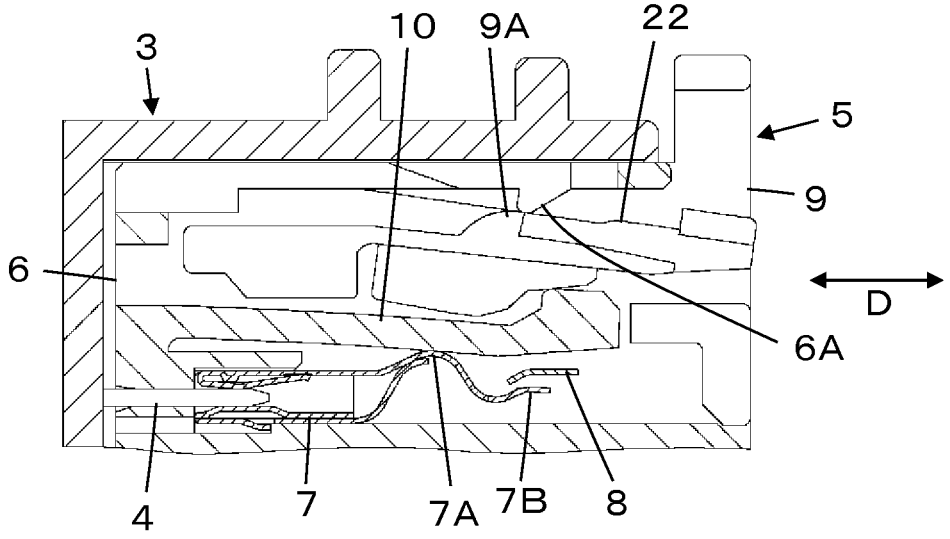
FIG. 25 PRIOR ART
FIG. 25 is a cross-sectional view showing another conventional connector assembly immediately before the fitting is established.

When the second spring piece 34 is restored to the initial position, the second end flat plate portion 38 having been displaced in the −Z direction as shown in FIG. 23A is moved in the +Z direction as shown in FIG. 23B. At this time, the taper face 38B formed at the side edge 38A of the second end flat plate portion 38 of the second spring piece 34 is brought into contact with the taper face 32A formed at the first end flat plate portion 32 of the first spring piece 31 and as shown in FIG. 23C, the first spring piece 31 is elastically deformed to displace the first end flat plate portion 32 in the −X direction. As a result, the stress acts on the first end flat plate portion 32 in the +X direction due to elastic resilience of the first spring piece 31 so that the side edge 38A of the second end flat plate portion 38 is connected to the first end flat plate portion 32 as wiping the surface of the first end flat plate portion 32. Thus, the second contact point of the fitting detection mechanism 17 is closed.

The second spring piece 34 can be manufactured by stamping a metal plate and in this case, the side edge 38A of the second end flat plate portion 38 is formed using a cross-section obtained through a shearing process and therefore has a rough surface. In addition, the side edge 38A of the second end flat plate portion 38 is moved by a long distance during an interval from when the side edge 38A is brought into contact with the surface of the first end flat plate portion 32 until when the protrusion 39 of the second end flat plate portion 38 is brought into contact with the surface of the plate portion 33 of the first socket 29. Therefore, an excellent wiping effect is exhibited and the possibility of poor electrical connection induced by foreign matter is eliminated, which enables the side edge 38A of the second end flat plate portion 38 to be reliably connected to the first end flat plate portion 32.

Furthermore, when the protrusion 39 of the second end flat plate portion 38 of the second socket 30 is brought into contact with the surface of the plate portion 33 of the first socket 29, the fourth contact point of the fitting detection mechanism 17 arranged in parallel to the second contact point is also closed, thereby improving the reliability of fitting detection.

Thus, the fitting detection mechanism 17 has the first, second and third contact points arranged in series between the first and second terminals 25 and 26 fixed at the first connector 11, with the first contact point being established between the first terminal 25 and the first socket 29, the second terminal being established between the first spring piece 31 formed at the first socket 29 and the second spring piece 34 formed at the second socket 30, and the third contact point being established between the second terminal 26 and the second socket 30; and when, after the first and third contact points are closed upon the movement of the manipulation lever 16, the manipulation lever 16 reaches the connector fitting position and the fitting lock mechanism locks the fitting state of the first connector 11 and the second connector 12, the second spring piece 34 is restored to the initial position so that the second spring piece 34 is, as wiping in the Z direction that is different from the fitting direction, brought into contact with the first spring piece 31, thereby closing the second contact point. Therefore, it is possible to reliably detect the fact that the fitting state of the first connector 11 and the second connector 12 has been locked.

Furthermore, the fitting detection mechanism 17 is constituted by only two components, i.e., the first and second sockets 29 and 30, thereby achieving the simple structure and the reduction in manufacturing cost.

While in the embodiment above, the explanation is made on the case where the second connector 12 is inserted in one of the two connector accommodating portions 14 formed in the first housing 13 of the first connector 11, the first and second terminals 25 and 26 are fixed also at the other connector accommodating portion 14 and when the second connector 12 is inserted in the other connector accommodating portion 14, the fitting between the first and second connectors 11 and 12 is carried out and the fact that the fitting state has been locked can be detected in the same manner.

The first connector 11 is not limited to the one having the two connector accommodating portions 14 and may have one or three or more connector accommodating portions 14.

What is claimed is:

1. A connector assembly, comprising:

a first connector having a first terminal and a second terminal which are used for fitting detection;

a second connector adapted to be fitted with the first connector;

a manipulation lever for use in fitting the second connector with the first connector along a fitting direction;

a fitting lock mechanism adapted to lock a fitting state of the first connector and the second connector; and a fitting detection mechanism disposed at the second connector and adapted to short-circuit between the first terminal and the second terminal when the first connector and the second connector are fitted with each other, wherein the fitting detection mechanism is constituted by only two components that are a first socket and a second socket both of which are made of metal, and forms a first contact point, a second contact point and a third contact point that are arranged in series between the first terminal and the second terminal, wherein the first contact point is established between the first terminal and the first socket which is disposed at the second connector and in which the first terminal is inserted along the fitting direction to be electrically connected to the first socket when the first connector and the second connector are fitted with each other, wherein the third contact point is established between the second terminal and the second socket which is disposed at the second connector and in which the second terminal is inserted along the fitting direction to be electrically connected to the second socket when the first connector and the second connector are fitted with each other, wherein the second contact point is established between a first spring piece integrally formed at the first socket and a second spring piece integrally formed at the second socket, wherein the second spring piece is in an initial position where the second spring piece is in contact with the first spring piece before the first connector and the second connector are fitted with each other, wherein when the manipulation lever is manipulated to start fitting between the first connector and the second connector, the second spring piece is pushed by the manipulation lever and separated from the first spring piece so that the second contact point is opened, and the first terminal and the second terminal are respectively inserted in the first socket and the second socket and, as wiping in the fitting direction, brought into contact with the first socket and the second socket so that the first contact point and the third contact point are closed, and wherein when the manipulation lever is manipulated to fit the first connector and the second connector with each other, while the fitting lock mechanism locks the fitting state of the first connector and the second connector, the second spring piece is released by the manipulation lever from a position where the second spring piece is pushed so that the second spring piece is restored to the initial position and, as wiping in a direction different from the fitting direction, brought into contact with the first spring piece so that the second contact point is closed whereby the first terminal and the second terminal are short-circuited.

2. The connector assembly according to claim 1, wherein the manipulation lever is attached to the second connector so as to be rotatable back and forth between a connector separating position and a connector fitting position along a lever moving plane.

3. The connector assembly according to claim 2, wherein the first spring piece has a first end flat plate portion that is elastically displaced in a direction along the lever moving plane, wherein the second spring piece has a second end flat plate portion that is elastically displaced in a direction perpendicular to the lever moving plane, and wherein when the manipulation lever reaches the connector fitting position and the second spring piece is restored to the initial position, a side edge of the second end flat plate portion of the second spring piece wipes a surface of the first end flat plate portion of the first spring piece and the second contact point is closed.

4. The connector assembly according to claim 3, wherein the first socket has a plate portion extending so as to overlap the second end flat plate portion of the second spring piece in parallel thereto, wherein the second spring piece has a protrusion that protrudes from a surface of the second end flat plate portion toward the plate portion of the first socket and that establishes, in combination with the plate portion of the first socket, a fourth contact point arranged in parallel to the second contact point, and wherein when the manipulation lever reaches the connector fitting position and the second spring piece is restored to the initial position, the protrusion of the second spring piece is brought into contact with the plate portion of the first socket and the fourth contact point is closed.

5. The connector assembly according to claim 2, wherein the fitting lock mechanism includes a lock arm formed at the manipulation lever and a lock arm receiving portion which is disposed at the first connector and on which the lock arm is caught when the manipulation lever reaches the connector fitting position, and wherein the second spring piece is pushed by way of the lock arm when the manipulation lever is moved from the connector separating position to the connector fitting position.

6. The connector assembly according to claim 5, wherein the second connector includes a movable arm which is disposed between the manipulation lever and the second spring piece and at which a jut is formed to project over the lever moving plane, and wherein when the manipulation lever is moved along the lever moving plane from the connector separating position to the connector fitting position, the jut is pushed by the lock arm so that the movable arm is elastically deformed, and the second spring piece is pushed by the movable arm.

7. The connector assembly according to claim 6, wherein when the manipulation lever is moved to the connector fitting position, the lock arm comes off from the jut so that the movable arm is released from its elastically-deformed position and the second spring piece is restored to the initial position.

8. A connector assembly, comprising:

a first connector having a first terminal and a second terminal which are used for fitting detection;

a second connector fitted with the first connector;

a manipulation lever for use in fitting the second connector with the first connector along a fitting direction, the manipulation lever being attached to the second connector so as to be rotatable back and forth between a connector separating position and a connector fitting position along a lever moping plane;

a fitting lock mechanism adapted to lock a fitting state of the first connector and the second connector; and a fitting detection mechanism disposed at the second connector and adapted to short-circuit between the first terminal and the second terminal when the first connector and the second connector are fitted with each other, wherein the fitting detection mechanism has a first contact point, a second contact point and a third contact point that are arranged in series between the first terminal and the second terminal when the first connector and the second connector are fitted with each other, wherein the first contact point is established between the first terminal and a first socket which is disposed at the second connector and in which the first terminal is able to be inserted along the fitting direction with fitting between the first connector and the second connector, wherein the third contact point is established between the second terminal and a second socket which is disposed at the second connector and in which the second terminal is able to be inserted along the fitting direction with fitting between the first connector and the second connector, wherein the second contact point is established between a first spring piece formed at the first socket and a second spring piece formed at the second socket, wherein the second spring piece is in an initial position where the second spring piece is in contact with the first spring piece before the first connector and the second connector are fitted with each other, wherein the first spring piece has a first end flat plate portion that is elastically displaced in a direction along the lever moving plane, and the second spring piece has a second end flat plate portion that is elastically displaced in a direction perpendicular to the lever moving plane, wherein when the manipulation lever is manipulated to start fitting between the first connector and the second connector, the second spring piece is pushed by the manipulation lever and separated from the first spring piece so that the second contact point is opened, and the first terminal and the second terminal are respectively inserted in the first socket and the second socket and, as wiping in the fitting direction, brought into contact with the first socket and the second socket so that the first contact point and the third contact point are closed, and wherein when the manipulation lever is manipulated and reaches the connector fitting position to fit the first connector and the second connector with each other, while the fitting lock mechanism locks the fitting state of the first connector and the second connector, the second spring piece is released by the manipulation lever from a position where the second spring piece is pushed so that the second spring piece is restored to the initial position, as a side edge of the second end flat plate portion of the second spring piece wipes a surface of the first end flat plate portion of the first spring piece in a direction different from the fitting direction, brought into contact with the first spring piece so that the second contact point is closed whereby the first terminal and the second terminal are short-circuited.

9. The connector assembly according to claim 8, wherein the first socket has a plate portion extending so as to overlap the second end flat plate portion of the second spring piece in parallel thereto, wherein the second spring piece has a protrusion that protrudes from a surface of the second end flat plate portion toward the plate portion of the first socket and that establishes, in combination with the plate portion of the first socket, a fourth contact point arranged in parallel to the second contact point, and wherein when the manipulation lever reaches the connector fitting position and the second spring piece is restored to the initial position, the protrusion of the second spring piece is brought into contact with the plate portion of the first socket and the fourth contact point is closed.

* * * * *